US007083074B2

(12) United States Patent
Chen

(10) Patent No.: US 7,083,074 B2
(45) Date of Patent: Aug. 1, 2006

(54) FASTENING STRUCTURE FOR COVER AND TOP SEAT OF MAGAZINE OF STAPLING GUN NOSE

(75) Inventor: Yung-Kwei Chen, Tali (TW)

(73) Assignee: Apach Industrial Co., Ltd., Tiachung (TW)

( * ) Notice: Subject to any disclaimer, the term of this patent is extended or adjusted under 35 U.S.C. 154(b) by 0 days.

(21) Appl. No.: 10/743,798

(22) Filed: Dec. 24, 2003

(65) Prior Publication Data

US 2005/0145669 A1 Jul. 7, 2005

(51) Int. Cl.
*B25C 3/00* (2006.01)

(52) U.S. Cl. ..... 227/123; 227/120; 227/127; 227/128

(58) Field of Classification Search ..... 227/120, 227/123, 127, 128
See application file for complete search history.

(56) References Cited

U.S. PATENT DOCUMENTS 4,688,710 A * 8/1987 Massari et al. ..... 227/109
6,318,618 B1 * 11/2001 Jen ..... 227/123
6,325,268 B1 * 12/2001 Liang ..... 227/123
6,598,776 B1 * 7/2003 Adachi et al. ..... 227/123
6,641,020 B1 * 11/2003 Yao ..... 227/109
6,763,989 B1 * 7/2004 Wang ..... 227/123
2003/0222116 A1 * 12/2003 Chen et al. ..... 227/139

* cited by examiner

*Primary Examiner*—Rinaldi I. Rada
*Assistant Examiner*—Nathaniel Chukwurah
(74) *Attorney, Agent, or Firm*—Rosenberg, Klein & Lee

(57) ABSTRACT

A stapling comprises a nose having a top seat, a nose cover, and a fastening latch. The top seat is mounted on the top of a magazine and is provided with a plurality of retaining portions. A top cover is provided with a plurality of retaining portions and is mounted on the top seat such that the retaining portions of the top cover are retained by the retaining portions of the top seat. The fastening latch is pivoted to the top cover such that a retaining ring of the fastening latch is retained by a holding slot of the retaining portions of the top seat. The top seat and the top cover are securely held together in such a way that they work together to confine a staple which is discharged by the stapling gun, thereby ensuring the accuracy and precision of driving staples.

5 Claims, 5 Drawing Sheets

FASTENING STRUCTURE FOR COVER AND TOP SEAT OF MAGAZINE OF STAPLING GUN NOSE

BACKGROUND OF THE INVENTION

1. Field of the Invention

The present invention relates generally to stapling gun, and more particularly to a structure for fastening a top cover and a top seat of magazine of a stapling gun.

2. Description of the Related Art

The conventional stapling gun comprises a nose which is composed of a top cover and a top seat. The top cover and the top seat are fastened together by means of screws. When a staple is driven improperly by the stapling gun such that the staple is deformed and stuck in the nose of the stapling gun, the deformed staple must be removed by unfastening the top cover from the top seat. The separation of the top cover from the top seat is attained by unfastening the screws by which the top seat and the top cover are fastened together. It is conceivable that the chore of unfastening and the fastening the screws is time-consuming and inconvenient.

SUMMARY OF THE INVENTION

The primary objective of the present invention is to provide a stapling gun with a structure for fastening the top cover and the top seat of a magazine of the stapling gun such that the top seat and the top cover can be unfastened with ease and speed.

It is another objective of the present invention to provide the stapling gun a nose with a high strength fastening structure of the top seat and the top cover of a magazine of the stapling gun. The fastening structure comprises a plurality of retaining portions perpendicular to the direction of a driven staple, thereby stabilizing the slot between the top seat and the top cover of the magazine.

The features and the advantages of the present invention will be more readily understood upon a thoughtful deliberation of the following detailed description of the preferred embodiments of the present invention with reference to the accompanying drawings.

DETAILED DESCRIPTION OF THE INVENTION

Figure 1:
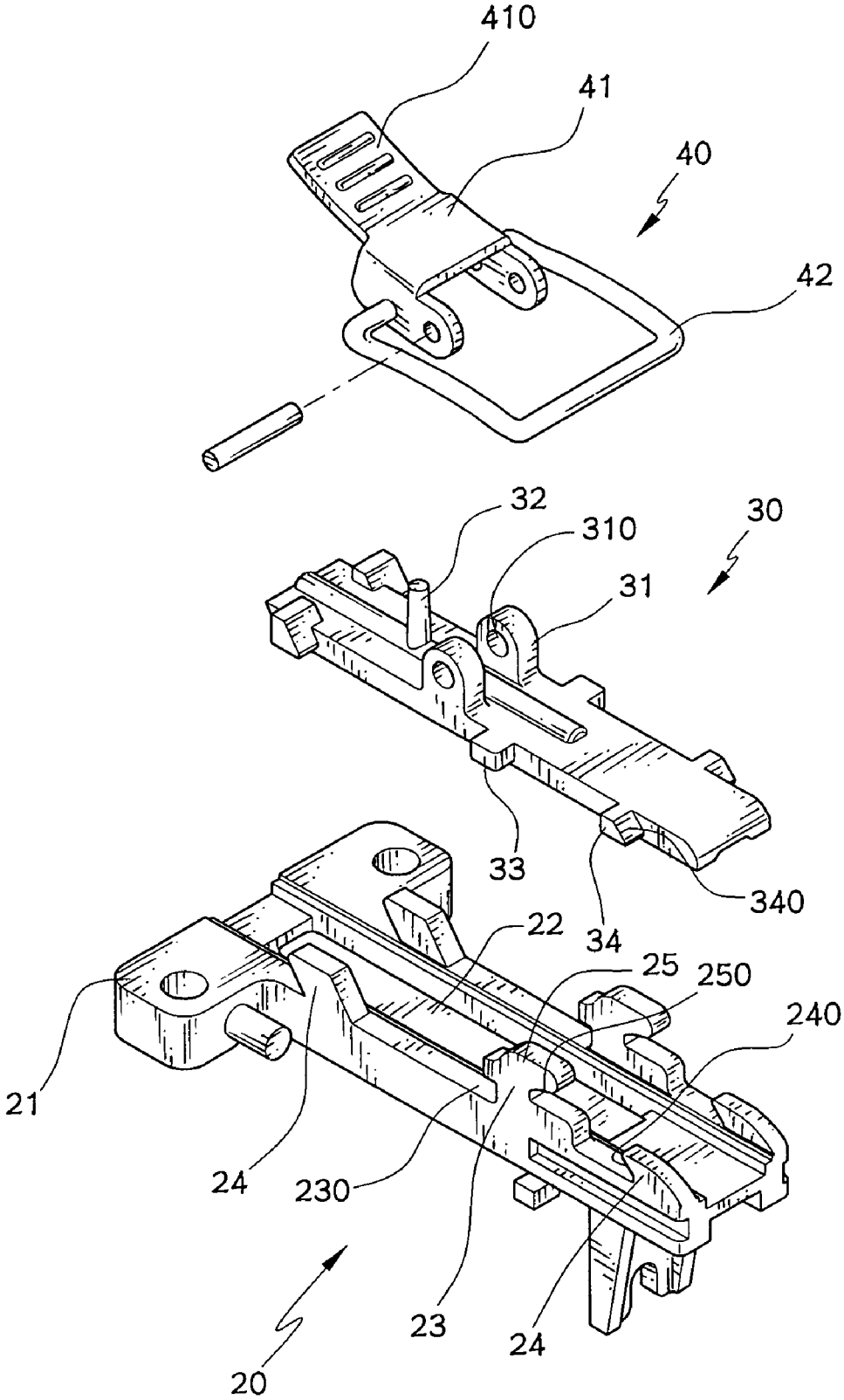
FIG. 1 shows an exploded view of a first preferred embodiment of the present invention.
Figure 2:
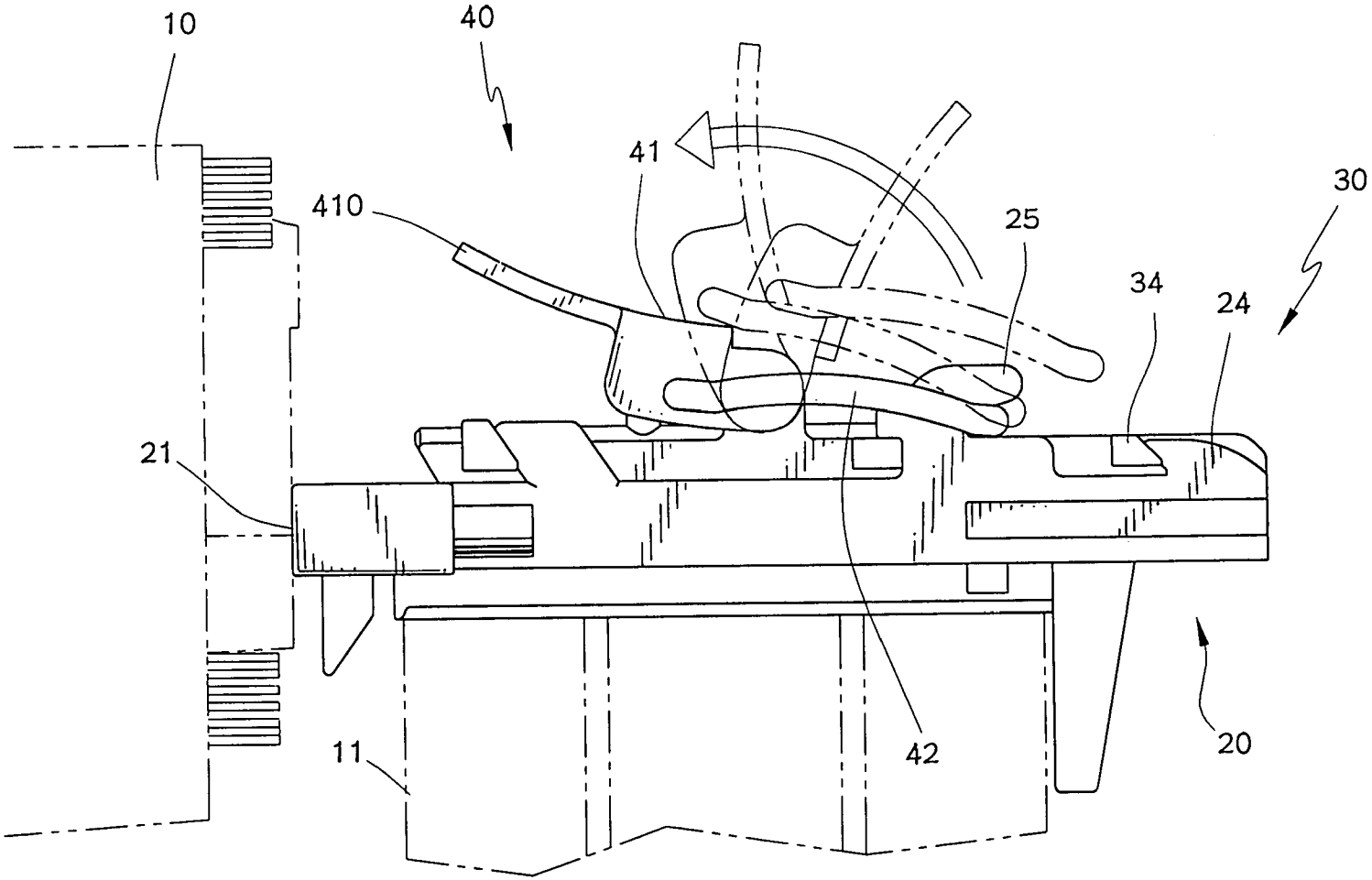
FIG. 2 shows a sectional schematic view of the first preferred embodiment of the present invention in combination.
Figure 3:
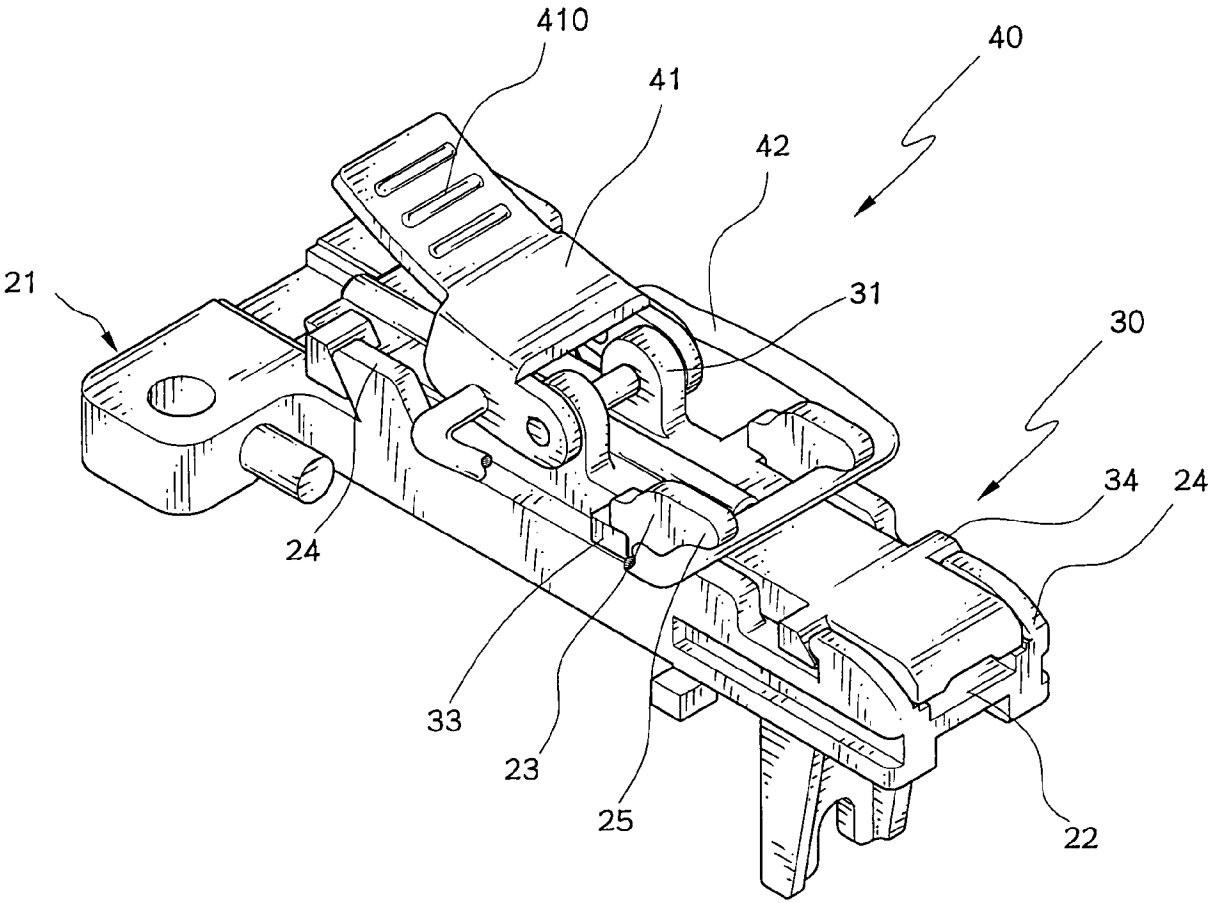
FIG. 3 shows a perspective view of the first preferred embodiment of the present invention in combination.

As shown in FIG. 1–3, a stapling gun 10 embodied in the present invention comprises a top seat 20, a top cover 30, and a fastening latch 40 for fastening the top seat 20 and the top cover 30, which are mounted on the magazine 11 of the stapling gun.

The top seat 20 is provided with a fastening portion 21 and a staple sliding slot 22. The top seat 20 is fastened with magazine by the fastener portion 21 in conjunction with a plurality of fastening bolts. The staple sliding slot 22 is used to allow movement of staple which is discharged by the stapling gun 10.

The top cover 30 is provided with two pivoting lugs 31, each having a pivoting hole 310. The top cover 30 is further provided with a support portion 32. The top cover 30 is mounted on the top seat 20 in conjunction with the fastening latch 40 which is pivoted with the top cover 30. The fastening latch 40 comprises a moving member 41, a retaining ring 42, and a pivot 43. The moving member 41 has a moving portion 410. The fastening latch 40 is pivoted with the top cover 30 by means of the pivot 43 which is put through the pivoting holes 310 of the top cover 30.

The present invention is characterized by the top seat 20 and the top cover 30. The top seat 20 is provided with two retaining portions 23 opposite to each other and having a retaining slot 230 perpendicular to the direction in which the top cover 30 is pushed by driven staple. The top seat 20 is further provided at one end with two fastening portions 24 opposite to each other, and two fastening slots 240 in alignment with the retaining slots 230. The fastening slots 240 are of an inclined construction. The retaining portions 23 are provided at the top with a hooked portion 25 which is in turn provided with a holding slot 250 opposite to the retaining slot 230 of the retaining portions 23 and the fastening slot 240 of the fastening portions 24. The top cover 30 is provided with two retaining portions 33 corresponding to the retaining portions 23 of the top seat 20. The top cover 30 is further provided with two fastening portions 34 corresponding to the two fastening portions 24 of the top seat 20. The fastening portions 34 are provided with a fastening edge 340 corresponding to the fastening slot 240 of the fastening portions 24 of the top seat 20.

Figure 5:
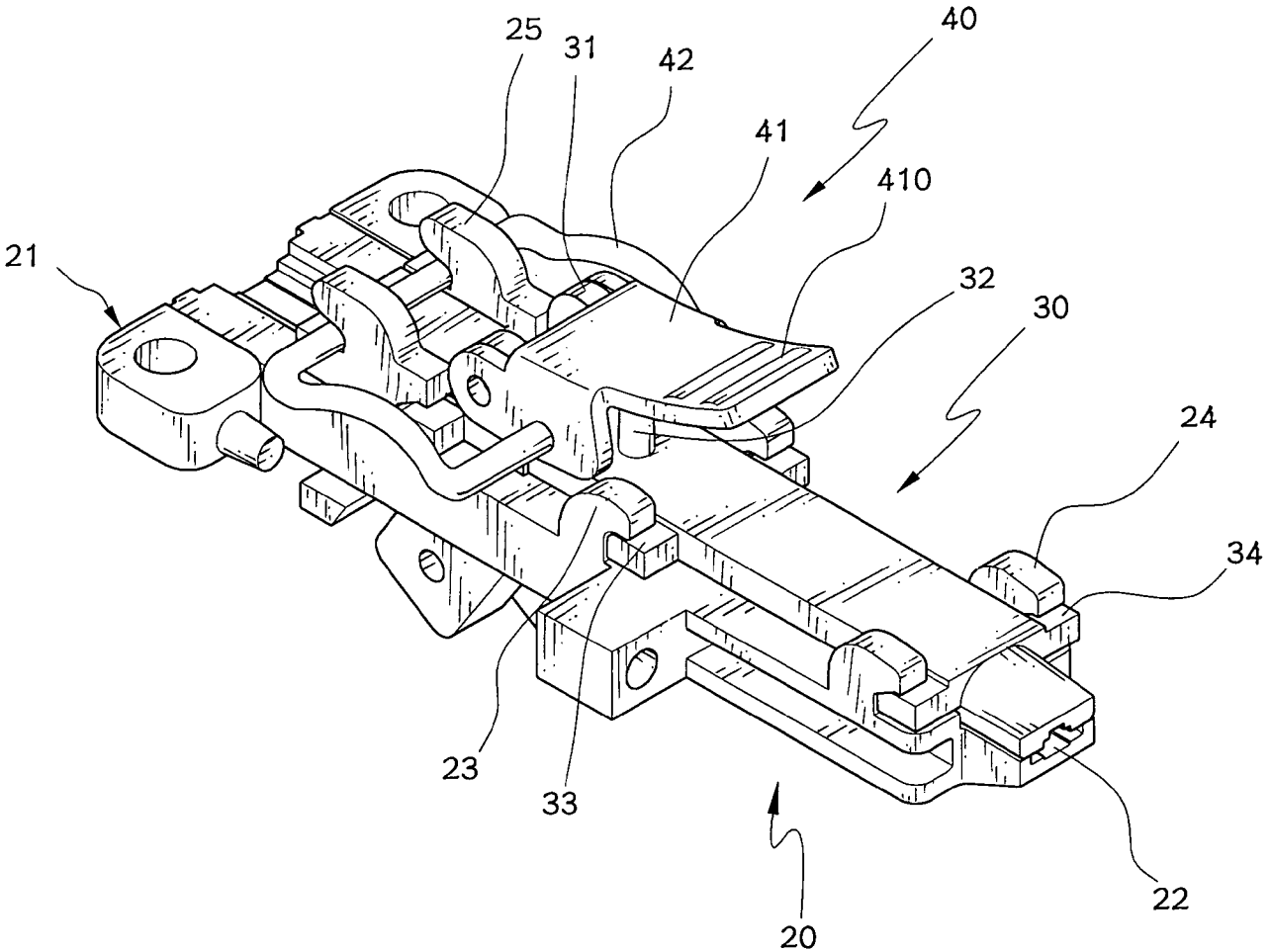
FIG. 5 shows a perspective view of the second preferred embodiment of the present invention in combination.

In combination, the top cover 30 is joined with the top seat 20 such that the fastening edge 340 is held securely in the fastening slot 240 of the top seat 20, and that the retaining portions 33 of the top cover 30 are retained in the retaining slots 230 of the retaining portions 23 of the top seat 20. Meanwhile, the retaining ring 42 of the fastening latch 40 is retained by the holding slot 250 of the hooked portions 25 of the top seat 20. The moving portion 410 of the moving member 41 of the fastening latch 40 is supported by the support portion 32 of the top cover 30, s shown in FIG. 5.

When a staple is driven to move along the staple sliding slot 22 of the top seat 20, the top cover 30 is exerted on by a pushing force perpendicular to the top cover 30. The pushing force is overcome by the retaining portions 23 of the top seat 20 and the retaining portions 33 of the top cover 30 thereby preventing the top cover 30 from moving away from the top seat 20. As a result, the driven staple is effectively confined by the top cover 30 and top seat 20 at the time when the driven staple is moving along the staple sliding slot 22 of the top seat 20. The driven staple thus prevented form being deformed.

Figure 4:
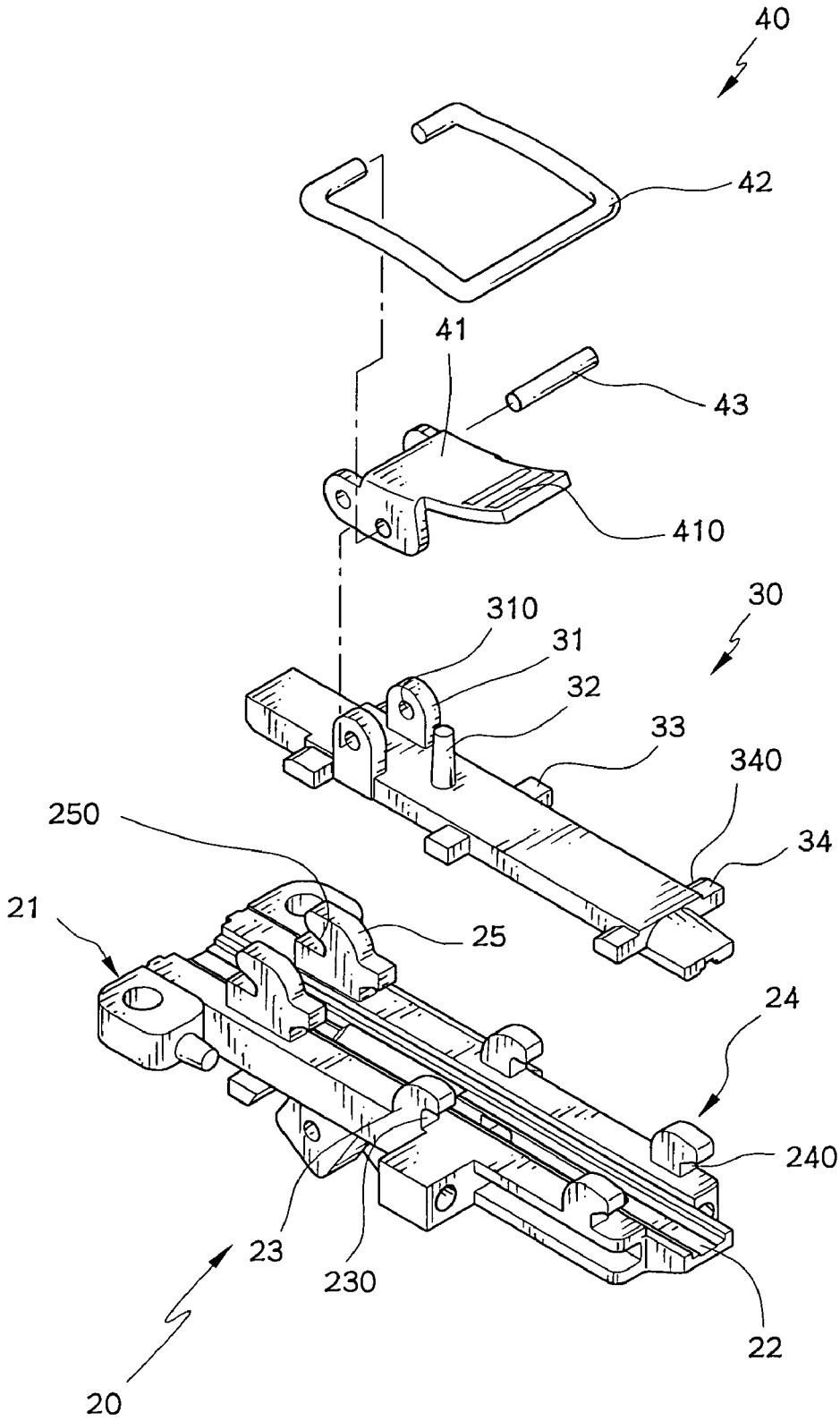
FIG. 4 shows an exploded view of a second preferred embodiment of the present invention.

As shown in FIG. 4, the top seat 20, the top cover 30, and the fastening latch 40 of the second preferred embodiment of the present invention are basically similar in construction to the counterparts of the first preferred embodiment described above, except that the positions of the retaining portions 23, the fastening portions 24, and the hooked portions 25 of the top seat 20 of the former are changed. Accordingly, the positions of the retaining portions 33, and the fastening portions 34 of the top cover 30 of the former are changed correspondingly. In spite of such changes as described above, the retaining mechanism of the present invention remains effective.

The embodiments of the present invention described above are to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A stapling gun comprising:

a magazine;

a top seat provided with a staple sliding slot and mounted on a top of said magazine;

a top cover mounted on said top seat; and a fastening latch pivoted with said top cover;

wherein, said top seat is provided with at least two retaining portions;

wherein said top cover is provided with at least two retaining portions, said top cover further provided with a support portion whereby said top cover is mounted on said top seat in such a manner that said retaining portions of said top cover are retained by said retaining portions of said top seat;

wherein said fastening latch comprises a moving member and a retaining ring, said fastening latch being pivoted with said top cover such that said moving member of said fastening latch is supported by said support portion of said top cover, and that said retaining ring is engaged with said retaining portions of said top seat; and, wherein at least one of said retaining portions of said top seat defines both a retaining slot for receiving one of said retaining portions of said top cover, and a hooking portion for engaging said retaining ring of said fastening latch.

2. The stapling gun as defined in claim 1, wherein said top seat is provided with at least two fastening portions;

said top cover is provided with at least two fastening portions, said fastening portions of said top cover being engaged with said fastening portions of said top seat.

3. The stapling gun as defined in claim 1, wherein said retaining portions of said top seat have a hooked portion which is provided with a holding slot; wherein said fastening latch is pivotally fastened with said top cover such that said retaining ring of said fastening latch is held in said holding slot of said hooked portion of said retaining portions of said top seat.

4. A stapling gun comprising:

a magazine;

a top seat provided with a staple sliding slot and mounted on a top of said magazine;

a top cover mounted on said top seat; and a fastening latch pivoted with said top cover;

wherein, said top seat is provided with at least two retaining portions;

wherein said top cover is provided with an elongate base and at least two retaining portions each protruding transversely therefrom, said top cover further provided with a support portion whereby said top cover is mounted on said top seat in such a manner that said retaining portions of said top cover extend from said elongate base for retentive engagement by retaining slots defined by said retaining portions of said top seat;

wherein said fastening latch comprises a moving member and a retaining ring, said fastening latch being pivoted with said top cover such that said moving member of said fastening latch is supported by said support portion of said top cover, and that said retaining ring is engaged with said retaining portions of said top seat.

5. A stapling gun comprising:

a magazine;

a top seat provided with a staple sliding slot and mounted on a top of said magazine;

a top cover mounted on said top seat; and a fastening latch pivoted with said top cover;

wherein said top seat is provided with at least two retaining portions and two fastening portions;

wherein said top cover is provided with at least two retaining portions and two fastening portions, said top cover further provided with a support portion whereby said top cover is mounted on said top seat in such a manner that said retaining portions of said top cover are retained by said retaining portions of said top seat, and that said fastening portions of said top cover are engaged with said fastening portions of said top seat;

wherein said fastening latch comprises a moving member and a retaining ring, said fastening latch being pivoted with said top cover such that said moving member of said fastening latch is supported by said support portion of said top cover, and that said retaining ring is engaged with said fastening portions of said top seat;

wherein at least one of said fastening portions of said top seat defines both a fastening slot for receiving one of said fastening portions of said top cover, and a hooking portion for engaging said retaining ring of said fastening latch.

* * * * *